US007537059B2

(12) United States Patent
Tjader

(10) Patent No.: US 7,537,059 B2
(45) Date of Patent: May 26, 2009

(54) DRILL ROD GREASING MAGAZINE AND METHOD

(75) Inventor: Michael Tjader, New Richmond, WI (US)

(73) Assignee: TT Technologies, Inc., Aurora, IL (US)

( * ) Notice: Subject to any disclaimer, the term of this patent is extended or adjusted under 35 U.S.C. 154(b) by 185 days.

(21) Appl. No.: 11/279,492

(22) Filed: Apr. 12, 2006

(65) Prior Publication Data

US 2006/0231261 A1 Oct. 19, 2006

Related U.S. Application Data

(60) Provisional application No. 60/672,305, filed on Apr. 18, 2005.

(51) Int. Cl.
*E21B 19/16* (2006.01)

(52) U.S. Cl. ..... 166/380; 166/77.51; 175/52; 175/85

(58) Field of Classification Search ..... 175/52, 175/85; 166/77.51, 380; 184/5, 5.1, 15.1–17, 184/105.1, 105.3
See application file for complete search history.

(56) References Cited

U.S. PATENT DOCUMENTS

| | | | | |
|---|---|---|---|---|
| 4,508,372 | A * | 4/1985 | White | 285/148.15 |
| 4,932,537 | A * | 6/1990 | Martinsen | 211/70.4 |
| 6,085,852 | A * | 7/2000 | Sparks et al. | 175/52 |
| 6,237,703 | B1 * | 5/2001 | Draney et al. | 175/162 |
| 6,374,927 | B1 * | 4/2002 | Guterman et al. | 175/52 |
| 6,543,555 | B2 * | 4/2003 | Casagrande | 175/85 |
| 6,550,547 | B1 * | 4/2003 | Payne et al. | 175/24 |
| 6,557,651 | B1 * | 5/2003 | Norby et al. | 175/52 |
| 7,240,742 | B2 * | 7/2007 | Sewell et al. | 175/52 |
| 2002/0153169 | A1 * | 10/2002 | Sewell | 175/52 |
| 2002/0157870 | A1 * | 10/2002 | Bischel et al. | 175/52 |
| 2004/0129455 | A1 * | 7/2004 | Koch et al. | 175/52 |
| 2005/0103526 | A1 * | 5/2005 | Ayling | 175/52 |
| 2005/0236157 | A1 * | 10/2005 | Logan | 166/377 |
| 2007/0119623 | A1 * | 5/2007 | Sewell et al. | 175/52 |

FOREIGN PATENT DOCUMENTS

WO WO03/060287 A1 * 7/2003

* cited by examiner

*Primary Examiner*—David J Bagnell
*Assistant Examiner*—Cathleen R Hutchins
(74) *Attorney, Agent, or Firm*—Schwegman, Lundberg & Woessner P.A.

(57) ABSTRACT

A magazine for greasing drill rods includes a magazine assembly couplable with a drill assembly, for instance, a directional drill. The magazine assembly includes a magazine coupled with the drilling assembly. The magazine is sized and shaped to house a plurality of drill rods. The magazine further arranges the plurality of drill rods so a fitting of each drill rod is in a predetermined pattern relative to other drill rod fittings. A cover is moveably coupled with magazine and sized and shaped to conceal the fittings of the plurality of drill rods when in a closed position. A method for greasing drill rods includes positioning a plurality of drill rods within the magazine. The magazine is sized and shaped to arrange the plurality of drill rods so a fitting of each drill rod is in a predetermined pattern relative to other fittings. The method further includes pre-greasing two or more of the fittings of the plurality of drill rods at one time.

17 Claims, 4 Drawing Sheets

DRILL ROD GREASING MAGAZINE AND METHOD

PRIORITY

This patent application claims the benefit of priority, under 35 U.S.C. Section 119(*e*), to U.S. Provisional Patent Application Ser. No. 60/672,205, filed on Apr. 18, 2005, which is incorporated herein by reference.

TECHNICAL FIELD

Greasing devices and in particular greasing devices for use in drill rods for ground drilling.

BACKGROUND

Devices such as directional drills are used in industry to bore openings underground for pipes, cables, etc. Directional drills typically use a number of drill rods to form a drill stem. The drill rods are inserted one at a time during a forward drilling operation, and are removed one at a time after the bore has reached a desired depth or length in order to remove the drill stem from the bore. Although an example of a directional drill is used in the following descriptions, other ground drills utilizing a number of drill rods to form a drill stem are also contemplated to be within the scope of the invention.

Drill rods are typically joined together to form the drill stem using a mating threaded joint formed with the ends of the drill rods. In one example, each drill rod includes a male fitting and a female fitting sized and shaped to engage with similar fittings on drill rods to form the drill stem. In this configuration, several drill rods can be housed in a small space (e.g., a magazine) prior to assembly along the drill stem. In some examples, the fittings of a drill rod are individually lubricated as the stem is assembled. The fittings are individually lubricate with, for instance, grease prior to coupling with another drill rod to form a portion of the drill stem. The lubrication of the fittings allows for easy coupling between the drill rods and also facilitates easy separation when the drill stem is removed from the bore.

Lubricating each fitting as needed to assemble the drill stem adds an additional step to the process of coupling a drill rod along the drill stem. This adds labor and cost to drilling. Moreover, it is easy for the operator to forget to grease the fittings or poorly grease the fittings thereby making coupling and uncoupling at the threaded joint difficult. Additionally, greasing is performed on the fittings with a wire brush and a container of grease, in some examples. This greasing technique can make a mess around the controls adjacent to the drill stem and around the driving unit for the directional drill making operation of the directional drill more difficult.

What is needed is a greasing apparatus and method that efficiently and cleanly applies grease to the fittings. What is also needed is a greasing apparatus and method that ensures application of grease to each fitting.

SUMMARY

The above described concerns such as labor, cost, ease of coupling and uncoupling are addressed by the drill rod magazine assembly and method. A magazine assembly is shown coupled with a directional drill assembly. The magazine assembly includes a magazine coupled with the drill assembly. The magazine is sized and shaped to house a plurality of drill rods and arrange the plurality of drill rods so a fitting of each drill rod is in a predetermined pattern relative to other drill rods. In one option, the fitting is a female fitting sized and shaped to receive a male fitting. The cover is moveably coupled with the magazine and is sized and shaped to conceal the fittings of the plurality of drill rods when the cover is in a closed position.

In another example, a method for greasing drill rods includes positioning a plurality of drills rods within a magazine. As described above, the magazine is sized and shaped to arrange the plurality of drill rods so a fitting of each drill rod is in a predetermined pattern relative to other fittings. The method also includes opening a cover concealing the fittings of the plurality of drill rods. At least two of the fittings are collectively pre-greased at one time in a pattern, for instance, prior to operation of a directional drill. Optionally, the predetermined pattern is used for pre-greasing or another organized pattern is used to pre-grease the fittings. Pre-greasing the fittings in an easy-to-follow pattern ensures all the fittings are greased. As a result, ease of coupling and uncoupling at each threaded joint between drill rods is ensured. Additionally, pre-greasing the fittings is performed in one step and not repeated on multiple occasions as drill rods are added to the drill stem. The single step pre-greasing decreases labor and the cost of performing multiple greasing operations. In one option, the method further includes closing the cover to conceal the fittings including grease that is pre-applied to the fittings. Contaminants such as dust and dirt are substantially prevented from becoming embedded within the grease thereby facilitating easy coupling between the fittings prior to use or during transportation of the directional drill assembly.

These and other embodiments, aspects, advantages, and features of the present invention will be set forth in part in the description which follows, and in part will become apparent to those skilled in the art by reference to the following description of the invention and referenced drawings or by practice of the invention. The aspects, advantages, and features of the invention are realized and attained by means of the instrumentalities, procedures, and combinations particularly pointed out in the appended claims and their equivalents.

DESCRIPTION OF THE EMBODIMENTS

In the following detailed description, reference is made to the accompanying drawings which form a part hereof, and in which is shown by way of illustration specific embodiments in which the invention may be practiced, These embodiments are described in sufficient detail to enable those skilled in the art to practice the invention, and it is to be understood that other embodiments may be utilized and that structural changes may be made without departing from the scope of the present invention. Therefore, the following detailed description is not to be taken in a limiting sense, and the scope of the present invention is defined by the appended claims and their equivalents.

Figure 1:
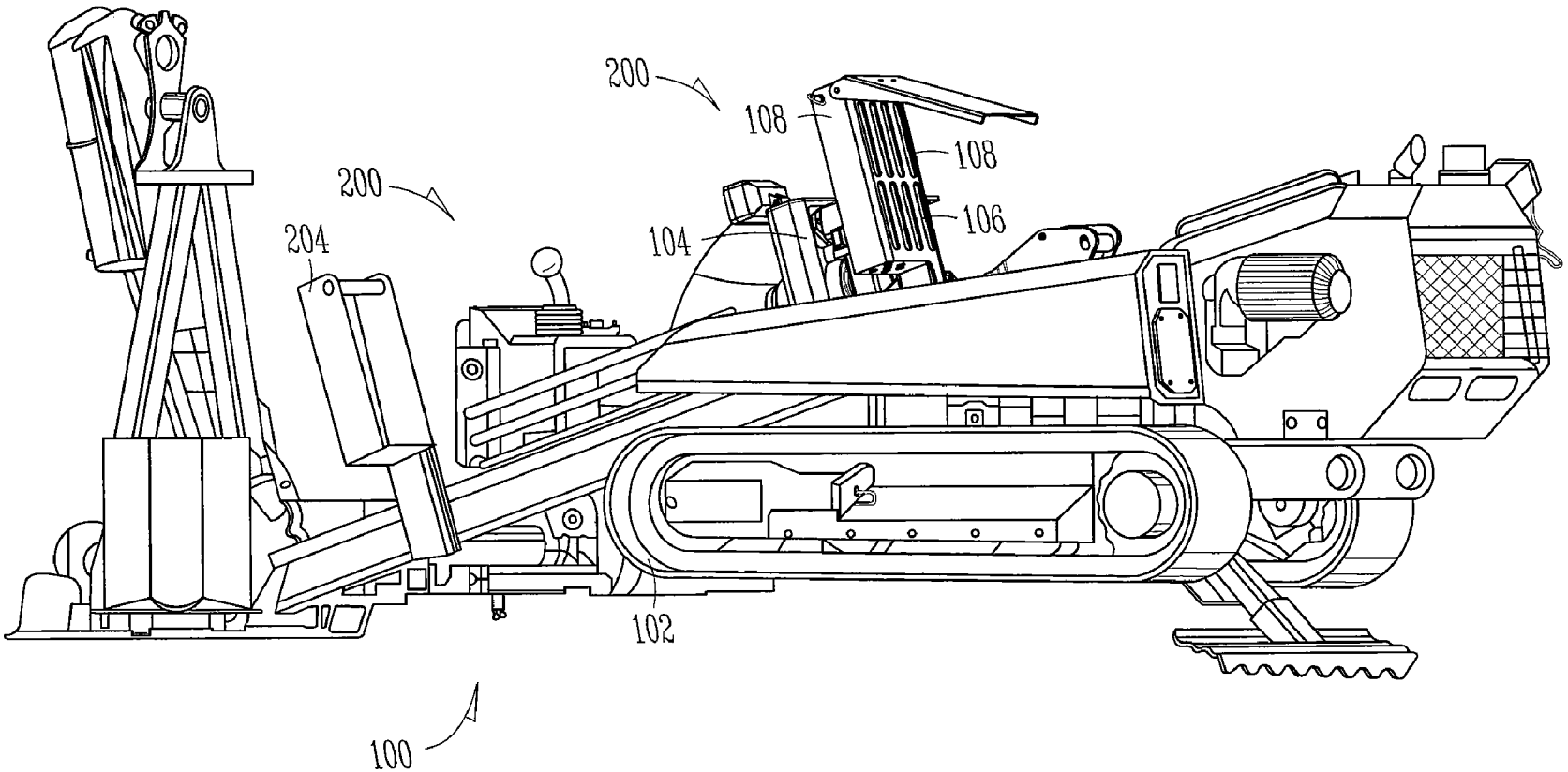
FIG. 1 is a perspective view of one example of a drill assembly.

FIG. 1 shows one example of a drilling assembly 100. As stated above, although an example of a directional drill is used in the following description, other ground drills utilizing a number of sections of drill stem are also contemplated to be within the scope of this document. The drilling assembly 100 is shown on a track system 102. In one example, the track system 102 facilitates transportation of the drilling assembly and positioning of the drilling assembly 100. In another example, other systems (e.g., wheeled systems or a combination of wheels and tracks) are used for moving and positioning the drilling assembly 100. In yet another example, the drilling assembly is stationary and does not include a system for moving and positioning.

As shown in FIG. 1, the drilling assembly 100 includes a drilling drive block 104. The drive block 104 provides rotation to a drill stem and advances the drill stem during a drilling operation. In one example, the drill assembly 100 advances a drill stem at an angle of incidence to the ground.

Figure 2:
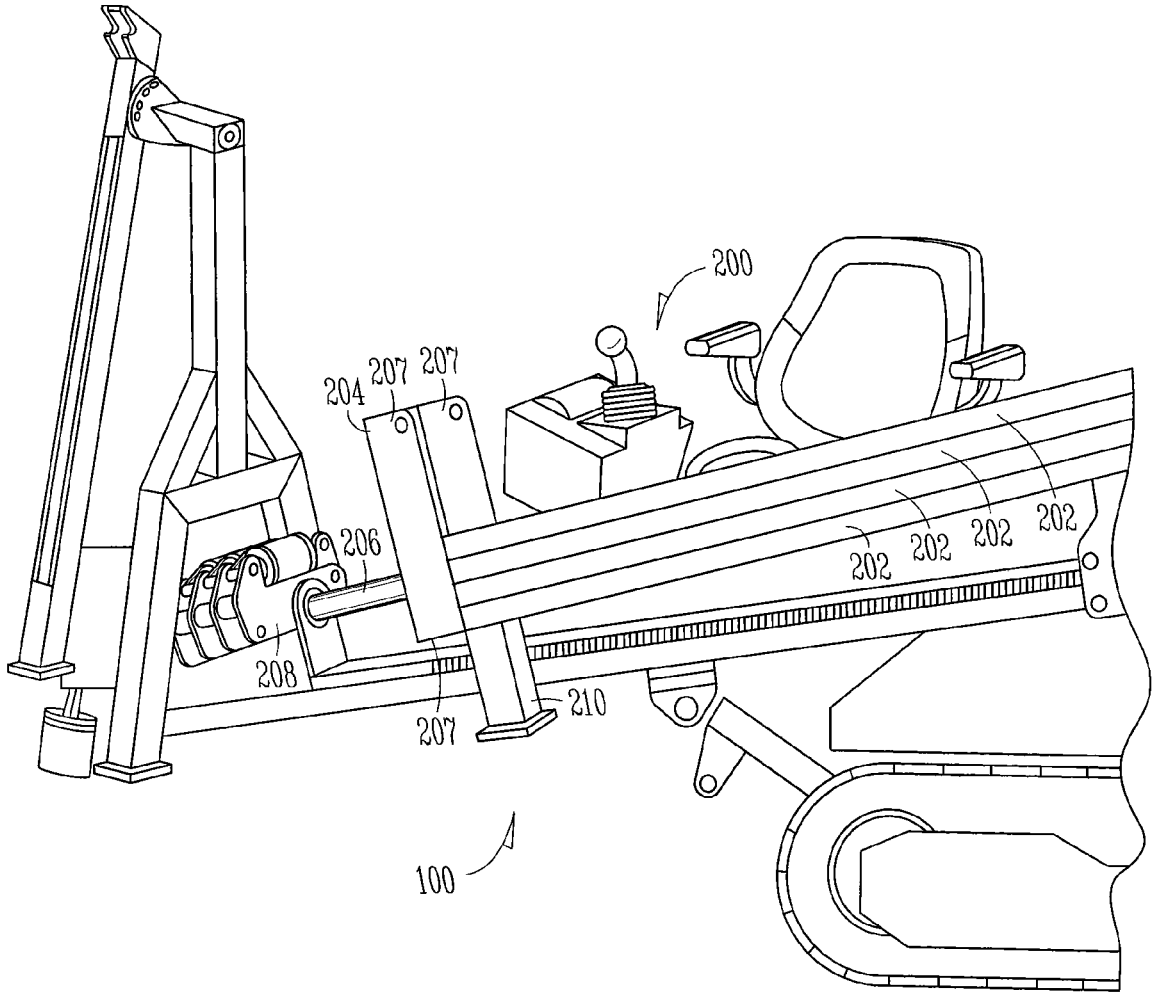
FIG. 2 is another perspective view of the drill assembly.

FIG. 2 shows a perspective view of the drill assembly 100. The drill assembly 100 includes a magazine 200 sized and shaped to store a plurality of drill rods 202. As shown in FIG. 2, a first portion 204 of the magazine 200 is sized and shaped to receive male fittings of the drill rods 202. In one example, the first portion 204 includes a frame 207 sized and shaped to extend around the drill rods 202 and retain the drill rods 202 within the first portion 204. Optionally, the first portion 204 is constructed with, but not limited to, steel or the like. The first portion 204 is coupled to the drill assembly 100, in another example, with a flange 210. The flange 210 is coupled to the directional drill by welding, fasteners, such as bolts or rivets, or the like. In another option, the flange 210 is integrally formed with at least a portion of the drill assembly 100. The drills rods 202 are removed from the magazine 200 as needed and positioned along the axis of the drill stem 206.

In one example, the drill assembly 100 includes a drill gripping device 208. The drill stem 206 is shown passing through a portion of the drill gripping device 208. Actuation of the drill gripping device 208 grasps and immobilizes the drill stem 206 to facilitate coupling off additional drill rods 202 with the drill stem 206. In another example, actuation of the drill gripping device 208 immobilizes the drill stem 206 for removal of drill rods 202 therefrom, for instance when it is desirable to retract the drill stem 206 from the ground.

Referring again to FIG. 1, the magazine 200 further includes a second portion 106 sized and shaped to receive female fittings of the drill rods 202 (FIG. 2). In one example, the drill rods 202 extend between the first and second portions 204, 106. Similarly to the first portion 204, the second portion 106 includes a frame 108 sized and shaped to receive female fittings of the drill rods 202 (FIG. 2). The first portion 204 and the second portion 106 are positioned apart from each other and cooperate to securely retain the drill rods 202. The male and female fittings of the drill rods 202 extend into the first and second portions, respectively, when the drill rods 202 are positioned with the magazine 200. As a result, the drill rods 202 are securely held by the magazine 200 until removed for coupling with the drill stem 206 (FIG. 2). In another example, the magazine 200 receives drill rods 202 uncoupled from the drill stem 206.

Figure 3:
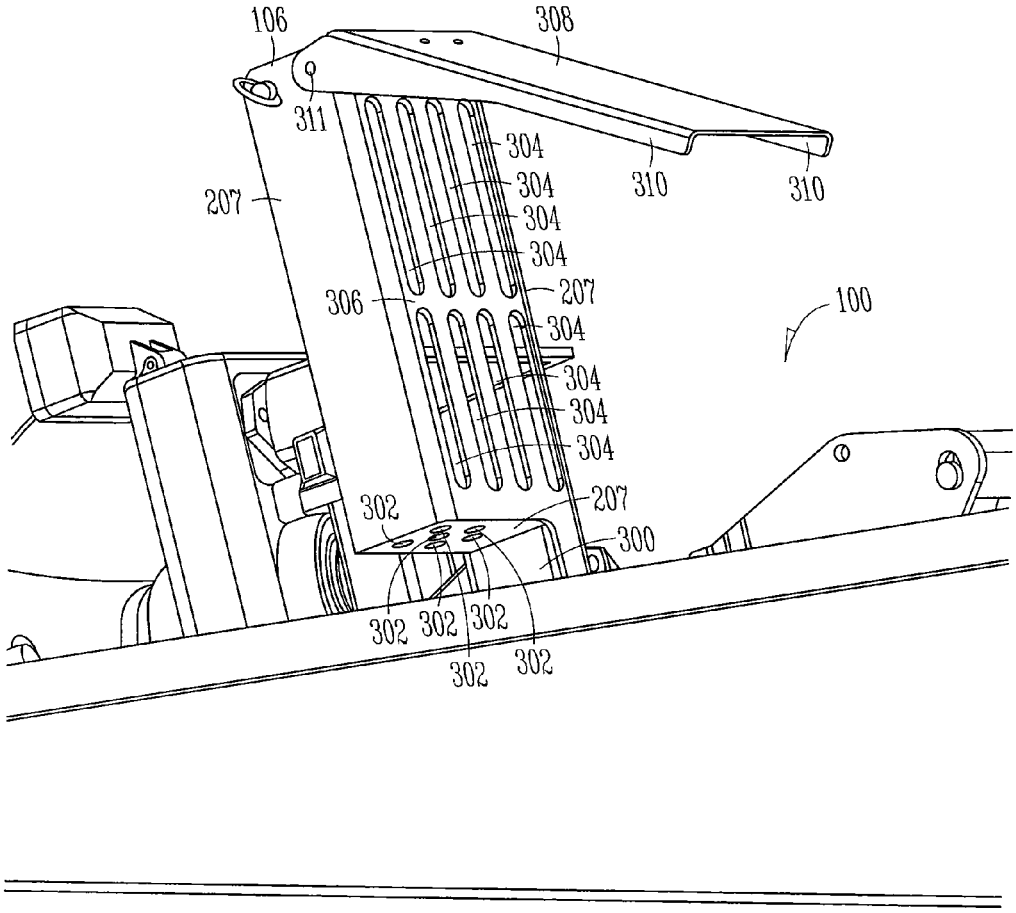
FIG. 3 is another perspective view of one example of a portion of a drill rod magazine.

FIG. 3 shows a detailed perspective view of the second portion 106. Similar to the first portioned 204, the second portion 106 is coupled with the drill assembly 100 with a flange 300. The flange 300 is integrally formed with the drill assembly 100, in one example. In another example, the flange 300 is coupled to the drill assembly 100 with fasteners, welds, or the like. The frame 207 of the second portion 106 includes drain holes 302 to facilitate drainage of liquids (greases, water or the like) and contaminants (e.g., dirt).

The frame 207 of the second portion 106 is sized and shaped to retain drill rods 202 (FIG. 2) in a predetermined pattern. In one example, the dimensions of the frame 207 (e.g., the height and width) correspond to multiples of the diameters of the drill rods 202. That is to say, the frame 207 is sized and shaped so at least the female fittings of the drill rods 202 stack within the second portion 106 in an orderly predetermined pattern relative to each other. In another example, the frame 207 is sized and shaped so the male fittings of the drill rods stack within the second portion 106 in a predetermined pattern. The second portion 106 includes slots 304 extending through a surface 306. The slots 304 are sized and shaped to align with the female fittings of the drill rods 202 (FIG. 2) when the drill rods 202 are stored within the second portion 106 in the predetermined pattern. The slots 304 thereby expose the female fittings for inspection and efficient application of grease. Because the frame 207 is dimensioned as described above, the slots 304 expose the female fittings in the predetermined pattern defined by the frame 207. Grease is applied through the slots 304 to the female fittings at a single time and in an easy-to-use and orderly pattern prior to use of the drill rods 202 (FIG. 2), in one option. The predetermined pattern and correspondingly organized exposed slots 304 facilitate pre-greasing of the female fittings (in the predetermined pattern or another organized pattern) without missing a fitting. Additionally, pre-greasing the fittings minimizes getting grime and grease residue on the drill assembly 100 (FIG. 1) controls. In one example, grease is applied in an up and down pattern along the slots with, for instance, a grease gun. Optionally, the grease is applied with a grease gun fitting sized and shaped to snugly fit within the slots 304. In another option, the grease gun fitting is sized and shaped to slidably couple with the surfaces defining the slots 304. The grease gun fitting ensures the grease is applied to the female fittings and not applied laterally away from the fittings. Additionally, the grease gun fitting permits continuous greasing of the female fittings exposed by the slot 304 with a continuous stream of grease as the grease gun is steadily moved along the slot 304. The up and down pattern follows the predetermined pattern created by the frame 207, in another example. In yet another example, the frame 207 and the slots 304 cooperate to expose the female fittings in another predetermined pattern (e.g., side-to-side, diagonal or the like).

In another example, the second portion 106 includes a cover 308 moveably coupled to the frame 207. The cover 308 is moveably coupled to the frame 207 by a hinge 311 in one example. The cover 308 is sized and shaped to move between a first open position and a second closed position. In the closed position the cover 308 substantially covers the slots 304 and the female fittings of the drill rods 202 (FIG. 2). In one example, the cover 308 includes skirts 310 sized and shaped to extend over at least a portion of the frame 207. The cover 308 substantially prevents the ingress of contaminants, such as dirt, dust and the like into the female fittings. Moreover, the cover 308 prevents ingress of moisture, such as rain water, snow or the like. The skirts 310 assist in preventing the ingress of contaminants and moisture by extending partially around the frame 207. Additionally, the cover 308 substantially prevents contaminants from lodging within the grease where the drill rods 202 are pre-greased prior to use. During at least transportation and storage of the drill assembly 100 the cover 308 is optionally positioned in the closed position to substantially cover the female fittings of the drill rods 202. In yet another example, at least one of the cover 308 and the frame 207 includes a positioning mechanism (e.g., torsion springs, descents or the like) that retains the cover 308 in the open position to provide access to the slots 304 and the female fittings for greasing.

Figure 4A:
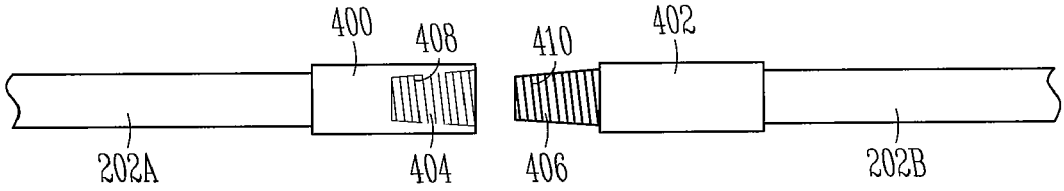
FIG. 4A is a side elevational view of the ends of two drill rods.
Figure 4B:
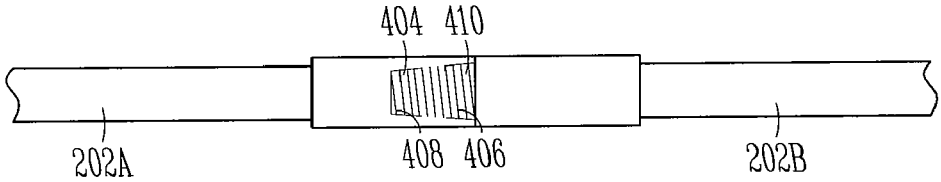
FIG. 4B is a side elevational view of two coupled drill rods.

Example ends 400, 402 of two respective drill rods 202A, B are shown in FIGS. 4A, B. As shown in FIG. 4A, the end 400 of drill rod 202A includes a female fitting 404 sized and shaped to receive the male fitting 406 of the drill rod 202B. In one example, the female fitting 404 includes threading 408 sized and shaped to cooperate with threading 410 of the male fitting 406. As shown in FIG. 4B, when the female fitting 404 is coupled with the male fitting 406, the threading 408, 410 engage each other to securely fasten the drill rods 202A, B together. Referring again to FIGS. 1 and 2 the drive unit 104 and the drill gripping device 208 cooperate to couple and uncouple drill rods 202A, B with the drill stem 206. For example, the drill gripping device 208 grasps the drill stem 206 including the drill rod 202A and the drive unit 104 disengages therefrom to allow positioning of the drill rod 202B coincidently with the drill stem 206. The drive unit 104 engages the drill rod 202B at a female fitting and rotates the male fitting 406 into engagement with the female fitting 404 of the drill rod 202A immobilized by the drill gripping device 208. The drill gripping device 208 then releases the drill rod 202A to permit further drilling by the drill stem 206. This process is repeated in reverse order to remove the drill rods 202 from the drill stem 206.

As described above, female fittings 404 of a plurality of drill rods 202 are exposed within the slots 304 to facilitate pre-greasing of the female fittings 404 prior to use of the drill assembly 100 (FIG. 1). The female fittings 404 are arranged in the predetermined pattern relative to each other and are thereby easily greased at a single time. Greasing the female fittings 404 at one time facilitates quick coupling and uncoupling of the drill rods 202 without greasing each fitting 404 prior to use of the drill rods 202. Additionally, greasing the female fittings 404 at one time and in a pattern (e.g., the predetermined pattern created by the magazine 200) reduces the chance of forgetting to grease the female fittings 404, for instance, at the time each drill rod 202 is used. Further, greasing the female fittings 404 at one time minimizes the application of residue grease to the controls of the drill assembly 100. In another example, male fittings 406 of the drill rods 202 are exposed in the slots 304 and organized in a predetermined pattern. The male fittings 406 may then be greased in a similar manner as described above for the female fittings 404.

Figure 5:
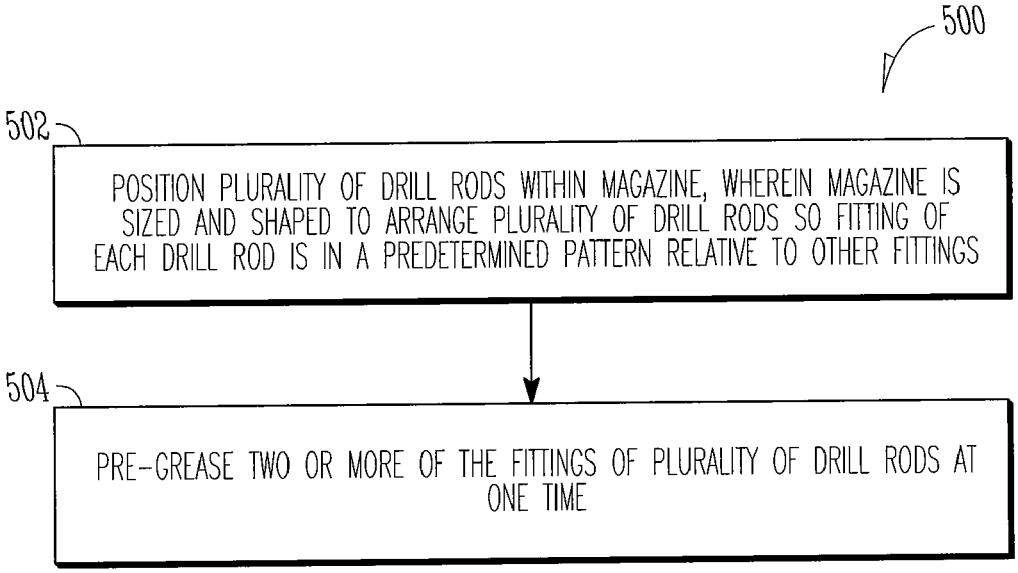
FIG. 5 is a block diagram for one example of a method for greasing drill rods.

FIG. 5 is a block diagram illustrating a method 500 for greasing drill rods within a magazine. One example of a magazine (e.g., magazine 200) is shown in FIGS. 1 and 2 and is referred to below. At 502, a plurality of drills rods 202 are positioned within the magazine 200 and the magazine 200 is sized and shaped to arrange the plurality of drill rods 202 so a fitting of each drill rod 202 is in a predetermined pattern relative to other fittings. At 504, the method 500 includes pre-greasing two or more of the fittings of the plurality of drill rods 202 at one time. In one example, the method 500 includes opening a cover 308 (FIG. 3) concealing the fittings of the plurality of drill rods. In another example, the cover 308 is closed and the fittings including grease therein are concealed. In still another example, the method 500 includes substantially isolating the fittings from contaminants.

Optionally, the method 500 includes positioning the plurality of drills rods 202 wherein the magazine 200 is sized and shaped to arrange the plurality of drill rods 202 so a female fitting 404 (FIG. 4) of each drill rod 202 is in a predetermined pattern relative to other female fittings 202 of additional drill rods 202. In one example, pre-greasing of the fittings is performed with a grease gun. The two or more fittings are pre-greased in a predetermined pattern, in another example. The two ore more fittings are pre-greased in a linear predetermined pattern (e.g., the pattern defined by the frame 207 and the slots 304 of the magazine 200), in yet another example.

In another example, the method 500 includes removing a first drill rod 202A from the magazine 200, where a female fitting 404 of the first drill rod 202 is pre-greased. A second drill rod 202B is removed from the magazine 200. The second drill rod 202B includes a male fitting 406 sized and shaped to engage with the pre-greased female fitting of the first drill rod 202A. The male fitting 406 of the second drill rod 202B is engaged with the pre-greased female fitting of the first drill rod 202A. In yet another example, drilling is performed with the first drill rod 202A, and the first drill rod 202A is engaged by a drive unit (e.g., drive unit 104). The first drill rod 202A is grasped with a drill gripping device (e.g., drill gripping device 208). The drive unit 104 is disengaged from the first drill rod 202A and the pre-greased female fitting 404 of the first drill rod 202A is exposed.

CONCLUSION

The examples of drill rod magazines and drill assemblies described herein provide an efficient and easy-to-use assembly for greasing drill rods. One advantage includes a magazine that organizes the fitting of drill rods in a predetermined pattern and provides access through slots to the fittings. Providing access through the slots allows for pre-greasing of the fittings at a single time to reduce labor. Additionally, a simple pattern may be followed by the operator during greasing to ensure all fittings are greased because of the predetermined pattern of the fittings. Ensuring all fittings are greased helps to prevent coupling and difficult uncoupling of ungreased fittings. Further, pre-greasing of the fittings minimizes the accumulation of grease residue on the controls for the drill assembly by greasing the fittings in a single step prior to use of the drill assembly.

Another advantage of the drill rod magazine examples includes a magazine having a cover sized and shaped to cover the fittings of the drill rods otherwise exposed through the slots in the magazine. After pre-greasing the cover is moved into a closed position to cover the fittings and prevent accumulation of contaminants, such as dirt and the like. Additionally, the cover allows pre-greasing and storage of the drill rods during transportation or during inclement weather.

Although selected advantages are detailed above, the list is not intended to be exhaustive. Although specific embodiments have been illustrated and described herein, it will be appreciated by those of ordinary skill in the art that any arrangement which is calculated to achieve the same purpose may be substituted for the specific embodiment shown. This application is intended to cover any adaptations or variations of the present invention. It is to be understood that the above description is intended to be illustrative, and not restrictive. Combinations of the above embodiments, and other embodiments will be apparent to those of skill in the art upon reviewing the above description. The scope of the invention includes any other applications in which the above structures and fabrication methods are used.

What is claimed is:

1. A method for greasing drill rods comprising:

positioning a plurality of drill rods within a magazine, the drill rods including rod ends having female fittings, wherein the magazine is sized and shaped to arrange female fittings of each drill rod relative to other female fittings within magazine slots, the rod ends concealed by the magazine except for the female fittings, and each of the magazine slots are sized and shaped to retain two or more female fittings, and the female fittings are visible through the slots while arranged within the magazine; and pre-greasing two or more of the female fittings of the plurality of drill rods at one time through the magazine slots while each female fitting is arranged within the magazine.

2. The method of claim 1, further comprising opening a cover concealing the fittings of the plurality of drill rods.

3. The method of claim 2, further comprising closing the cover wherein the fittings including grease therein are concealed.

4. The method of claim 1, wherein positioning the plurality of drill rods includes positioning a male portion of a drill rod within a first magazine portion, and positioning a female portion of the drill rod within a second magazine portion, wherein the female portion includes the female fitting.

5. The method of claim 1, wherein positioning the plurality of drills rods within the magazine includes positioning the plurality of drill rods wherein the magazine is sized and shaped to arrange the plurality of drill rods so the female fitting of each drill rod is in a predetermined pattern relative to other drill rods.

6. The method of claim 1, wherein pre-greasing includes pre-greasing with a grease gun along the magazine slot.

7. The method of claim 1, wherein pre-greasing includes pre-greasing the two or more fittings in a predetermined pattern through the magazine slots.

8. The method of claim 7, wherein pre-greasing includes pre-greasing the two or more fittings in a linear predetermined pattern.

9. The method of claim 1, further comprising:

removing a first drill rod from the magazine, wherein the female fitting of the first drill rod is pre-greased;

removing a second drill rod from the magazine, wherein the second drill rod includes a male fitting sized and shaped to engage with the pre-greased female fitting of the first drill rod;

engaging the male fitting of the second drill rod with the pre-greased female fitting of the first drill rod.

10. The method of claim 9, further comprising:

drilling with the first drill rod, wherein the first drill rod is engaged by a drive unit;

grasping the first drill rod with a drill gripping device; and disengaging the drive unit from the first drill rod, wherein the pre-greased female fitting of the first drill rod is exposed.

11. The method of claim 6, wherein pre-greasing with a grease gun includes slidably coupling a grease gun fitting with the magazine slot, the grease gun fitting movable along the magazine slot over the female fittings.

12. The method of claim 11, wherein slidably coupling the grease gun fitting with the magazine slot includes slidably coupling the grease gun fitting with flanges on opposing sides of the magazine slot, engagement between the grease gun fitting and the flanges constraining pre-greasing of the two or more female fittings to a path directly overlaying the two or more female fittings.

13. A method for greasing drill rods comprising:

positioning a plurality of drill rods within a magazine, the drill rods including shafts and rod ends having female fitting orifices, the rods ends extending around the female fitting orifices, the rod ends having a rod end diameter greater than a female orifice diameter;

arranging two or more rod ends within a first magazine slot of a plurality of magazine slots, wherein flanges extend along each side of each magazine slot and overlay a portion of the rod ends, the flanges sized and shaped to engage with the rod ends and substantially prevent longitudinal movement of the drill rods relative to the magazine, and the distance across each magazine slot is less than the rod end diameter and substantially similar to the female orifice diameter, the female orifices are between the flanges and accessible through the magazine slots;

pre-greasing the two or more female fitting orifices of the two or more rod ends at one time while the two or more rod ends are arranged in the first magazine slot, pre-greasing performed through the first magazine slot.

14. The method of claim 13, wherein pre-greasing the two or more female fitting orifices includes pre-greasing the two or more female fitting orifices with a grease gun moved along at least the first magazine slot.

15. The method of claim 14, wherein pre-greasing the two or more female fitting orifices with the grease gun includes slidably coupling a grease gun fitting with the flanges along at least the first magazine slot.

16. The method of claim 15, wherein slidably coupling the grease gun fitting with the flanges includes the grease gun fitting engaging with the flanges to substantially prevent lateral movement of the grease gun fitting relative to the first magazine slot, and pre-greasing of the two or more female fitting orifices is constrained to a path directly overlaying the two or more female fitting orifices.

17. The method of claim 13, wherein arranging two or more rod ends within the first magazine slot includes arranging two or more rod ends within the first magazine slot where the magazine extends longitudinally along the rod ends parallel to longitudinal axes of the plurality of drill rods, and the flanges extend substantially perpendicular relative to the longitudinal axes of the plurality of drill rods.

* * * * *